US010304611B2

(12) United States Patent
Moon

(10) Patent No.: US 10,304,611 B2
(45) Date of Patent: May 28, 2019

(54) CHIP INDUCTOR AND METHOD OF MANUFACTURING THE SAME

(71) Applicant: SAMSUNG ELECTRO-MECHANICS CO., LTD., Suwon-si, Gyeonggi-do (KR)

(72) Inventor: Byeong Cheol Moon, Suwon-si (KR)

(73) Assignee: Samsung Electro-Mechanics Co., Ltd., Suwon-si, Gyeonggi-do (KR)

( * ) Notice: Subject to any disclaimer, the term of this patent is extended or adjusted under 35 U.S.C. 154(b) by 63 days.

(21) Appl. No.: 15/385,371

(22) Filed: Dec. 20, 2016

(65) Prior Publication Data

US 2017/0345549 A1 Nov. 30, 2017

(30) Foreign Application Priority Data

May 30, 2016 (KR) ..... 10-2016-0066795

(51) Int. Cl.

| | |
|---|---|
| ***H01F 27/29*** | (2006.01) |
| ***H01F 27/28*** | (2006.01) |
| ***H01F 41/063*** | (2016.01) |
| ***H01F 27/245*** | (2006.01) |
| ***H01F 27/32*** | (2006.01) |
| ***H01F 41/02*** | (2006.01) |
| ***H01F 17/00*** | (2006.01) |
| ***H01F 17/04*** | (2006.01) |
| ***H01F 41/04*** | (2006.01) |

(52) U.S. Cl.

CPC ..... *H01F 27/2804* (2013.01); *H01F 17/0013* (2013.01); *H01F 17/04* (2013.01); *H01F 27/245* (2013.01); *H01F 27/29* (2013.01); *H01F 27/292* (2013.01); *H01F 27/323* (2013.01); *H01F 41/0233* (2013.01); *H01F 41/0293* (2013.01); *H01F 41/046* (2013.01); *H01F 41/063* (2016.01); *H01F 2017/0066* (2013.01); *H01F 2027/2809* (2013.01)

(58) Field of Classification Search

CPC ..... H01F 27/00–27/36
USPC ..... 336/65, 83, 200, 232–234
See application file for complete search history.

(56) References Cited

U.S. PATENT DOCUMENTS 5,239,744 A * 8/1993 Fleming ..... B28B 1/48 264/272.15
6,515,568 B1 2/2003 Maki et al.
(Continued)

FOREIGN PATENT DOCUMENTS

JP 2001-044039 A 2/2001
JP 2010-153618 A 7/2010
(Continued)

OTHER PUBLICATIONS

Notice of Office Action in corresponding Korean Application No. 10-2016-0066795, dated Jul. 20, 2017.

*Primary Examiner* — Tuyen T Nguyen
(74) *Attorney, Agent, or Firm* — Morgan, Lewis & Bockius LLP

(57) ABSTRACT

A chip inductor comprises a laminate including a plurality of sheets stacked therein; a coil disposed in the laminate and including an exposed portion, in which a portion of the coil is exposed outwardly of at least one surface of the laminate; and a non-magnetic insulating layer disposed on an external surface of the laminate to cover the exposed portion of the coil.

7 Claims, 9 Drawing Sheets

(56) References Cited

U.S. PATENT DOCUMENTS

| | | | | |
|---|---|---|---|---|
| 7,719,398 | B2 * | 5/2010 | Tsuzuki | H01F 17/0013 336/200 |
| 7,817,007 | B2 * | 10/2010 | Lee | H01F 3/14 336/200 |
| 8,890,646 | B2 * | 11/2014 | Noguchi | H01F 17/0013 336/200 |
| 2010/0283447 | A1 | 11/2010 | Tachibana et al. | |

FOREIGN PATENT DOCUMENTS

| | | | |
|---|---|---|---|
| KR | 10-0888437 | B1 | 3/2009 |
| KR | 2010-0094456 | A | 8/2010 |
| KR | 10-2013-0046108 | A | 5/2013 |
| KR | 10-2014-0084978 | A | 7/2014 |

* cited by examiner

CHIP INDUCTOR AND METHOD OF MANUFACTURING THE SAME

CROSS-REFERENCE TO RELATED APPLICATION

This application claims the benefit of priority to Korean Patent Application No. 10-2016-0066795, filed on May 30, 2016 with the Korean Intellectual Property Office, the entire disclosure of which is incorporated herein by reference.

TECHNICAL FIELD

The present disclosure relates to a chip inductor and a method of manufacturing the same.

BACKGROUND

Recently, as the use of electronic communications devices has increased, mutual interference between such devices has caused problems, such as communications failures and the like. Consequently, in order to improve an electromagnetic environment in which wireless communications and multimedia devices are used, countries have tightened regulations related to electromagnetic interference.

Due to this trend, there has been increased development of devices aimed at eliminating electromagnetic interference. In addition, demand for components has increased, and technology has been developed that allows for multifunctionalization, as well as the implementation of miniaturization and high efficiency.

As portable devices, such as smartphones, tablet PCs, and the like, have been developed, the use of an accelerated processing unit (APU) in a high-speed dual-core processor or quad-core processor and a wide display device has been expanded. Various metal complex inductors formed in such a manner that metal powder having excellent direct current (DC)-bias characteristics and an organic material are combined have been launched.

Since metals have conductivity, thus causing eddy current loss, metals have not commonly been used in high frequency inductors. Recently, however, metal compounds including an organic material have been manufactured to have fine powder form, and surfaces of particles thereof have been coated for insulation. Therefore, eddy current loss has been reduced, and thus, metals may be used in a frequency domain of 1 MHz or higher. However, a problem in which various metals remain difficult to use in a frequency domain of 10 MHz or higher, due to current loss, exists.

SUMMARY

An aspect of the present disclosure provides a chip inductor increasing inductance in such a manner that an area of a coil disposed in a laminate is increased and improving direct current (DC)-bias characteristics in such a manner that magnetic flux is blocked.

In addition, another aspect of the present disclosure provides a method of manufacturing a chip inductor having increased inductance and improved DC-bias characteristics.

According to an aspect of the present disclosure, a chip inductor comprises a laminate including a plurality of sheets stacked therein; a coil disposed in the laminate and including an exposed portion in which a portion of the coil is exposed outwardly of at least one surface of the laminate; and a non-magnetic insulating layer disposed on an external surface of the laminate to cover the exposed portion of the coil.

According to an aspect of the present disclosure, a method of manufacturing a chip inductor comprises providing a first sheet formed of a magnetic material and a second sheet formed of a non-magnetic material; forming a coil pattern on the second sheet, the coil pattern including an exposed portion in contact with an edge of a surface of the second sheet; forming a magnetic layer including a nickel oxide (NiO) in a central region on the second sheet; forming a laminate including a coil therein by stacking the first sheet, a plurality of second sheets, and the first sheet in sequence; and forming a non-magnetic insulating layer to cover the exposed portion of the coil, exposed outwardly of the laminate.

BRIEF DESCRIPTION OF THE DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will be described as follows with reference to the attached drawings. The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

It will be apparent that though the terms first, second, third, etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Chip Inductor

Figure 1:
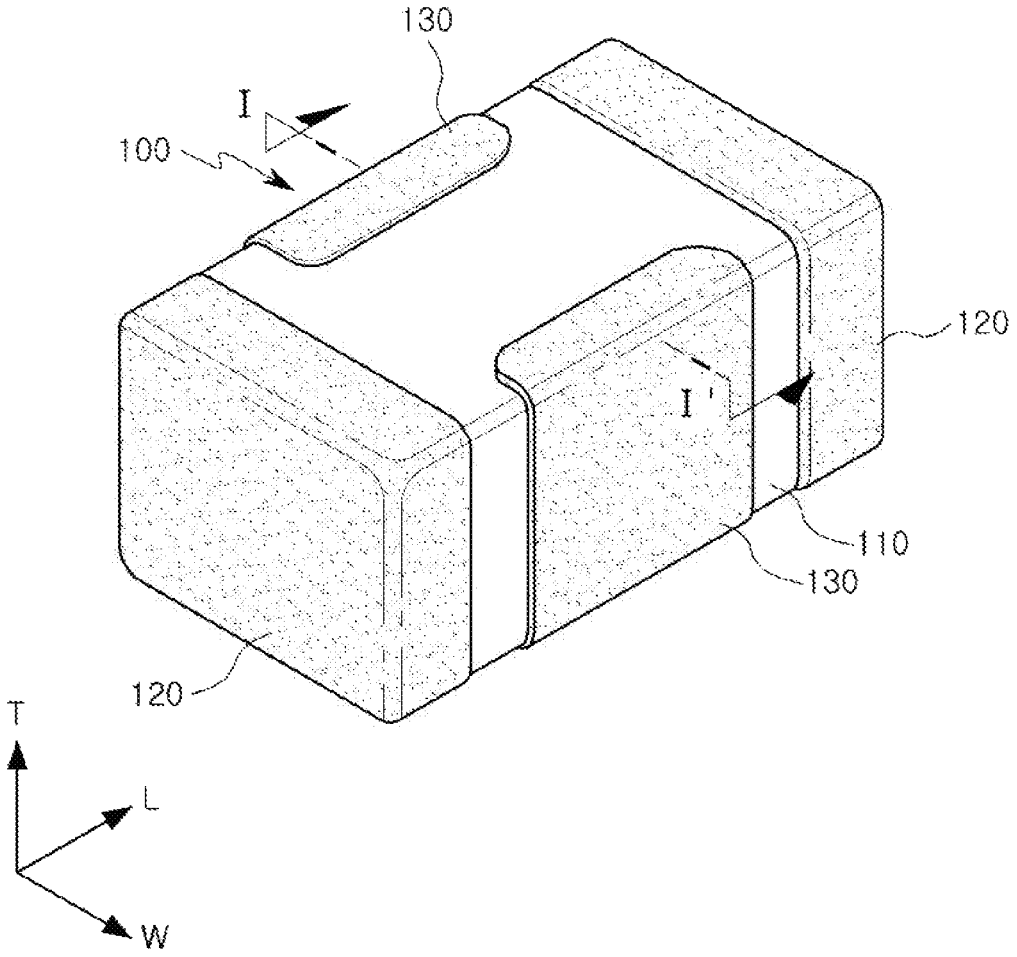
FIG. 1 is a schematic perspective view of a chip inductor according to an exemplary embodiment.
Figure 2:
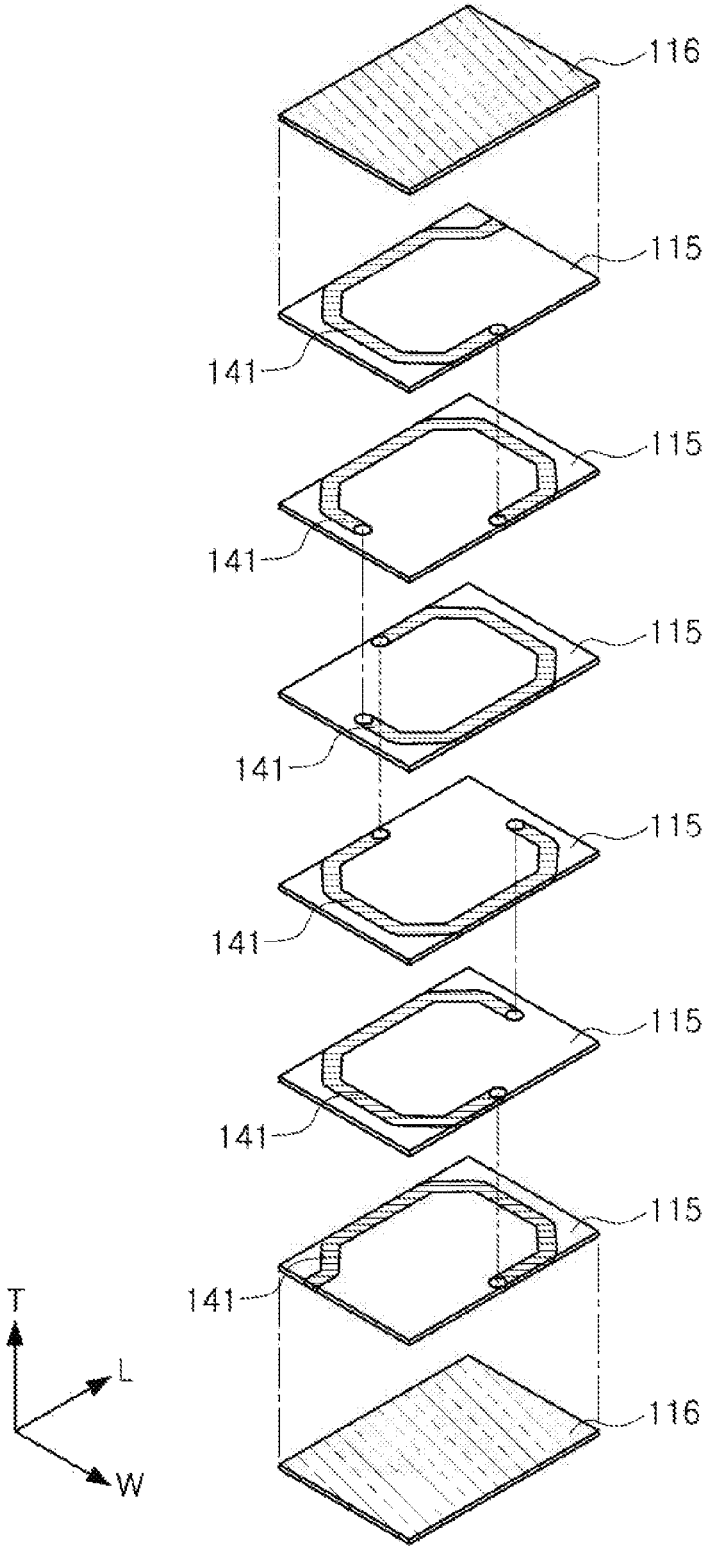
FIG. 2 is a schematic exploded perspective view of a chip inductor according to an exemplary embodiment.
Figure 3:
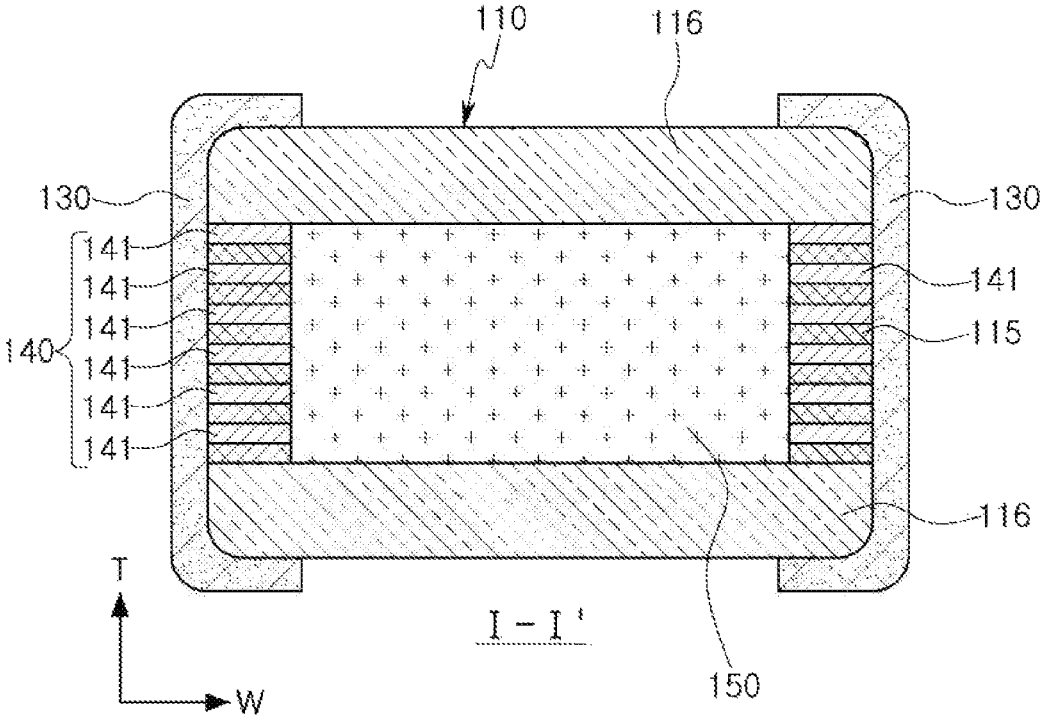
FIG. 3 is a schematic cross-sectional view taken along line I-I' of FIG. 1.

FIG. 1 is a schematic perspective view of a chip inductor according to an exemplary embodiment, FIG. 2 is a schematic exploded perspective view of a chip inductor according to an exemplary embodiment, and FIG. 3 is a schematic cross-sectional view taken along line I-I' of FIG. 1.

Hereinafter, a structure of a chip inductor 100, according to an exemplary embodiment, will be described with reference to FIGS. 1 to 3.

The chip inductor 100, according to an exemplary embodiment, may include a laminate 110, an external electrode 120 disposed on opposing surfaces of the laminate 110 in a length direction L, and a non-magnetic insulating layer 130 disposed on opposing side surfaces of the laminate 110 in a width direction W.

The laminate 110 may include a cover layer 116, formed using a magnetic material, disposed in upper and lower portions thereof. Since the cover layer 116 includes a magnetic material, magnetic flux may flow therein.

The laminate may include a coil 140 disposed therein. The coil 140 may be formed in such a manner that, as illustrated in FIG. 2, a spiral coil pattern 141 is formed on sheets 115, the sheets 115 are stacked, and respective coil patterns 141 disposed adjacently to each other in a stacking direction are connected to each other by a conductive via. When the coil 140 is projected from a top surface in a vertical direction, the coil 140 may configure a loop-type pattern in such a manner that the coil patterns 141 are stacked. In other words, the coil 140 may configure the loop-type pattern when viewed from above.

A diffusion portion 150 may be disposed in a central region of the loop-type pattern, that is, in a central region of the coil 140.

The diffusion portion 150 may be formed of a nickel (Ni)-copper (Cu)-zinc (Zn) ferrite, and may act as a core of the coil 140. As described subsequently, the diffusion portion 150 may be formed in such a manner that a magnetic layer including nickel oxide (NiO) is formed on the sheet 115 formed of a non-magnetic material, and in a sintering process, NiO is diffused into the sheet 115 in a location in which the sheet 115 is in contact with the magnetic layer.

A method of forming the diffusion portion 150 will also be described below in a description of a method of manufacturing a chip inductor.

Figure 4:
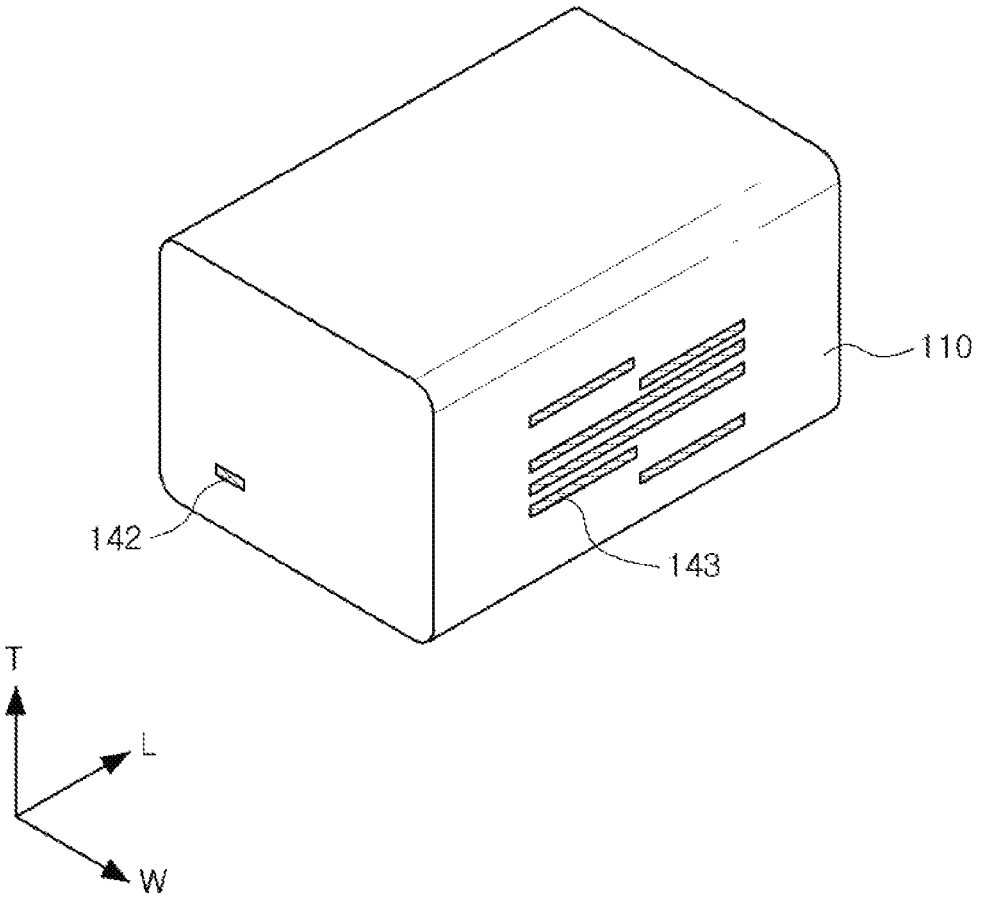
FIG. 4 is a schematic perspective view of a laminate of a chip inductor according to an exemplary embodiment.
Figure 5:
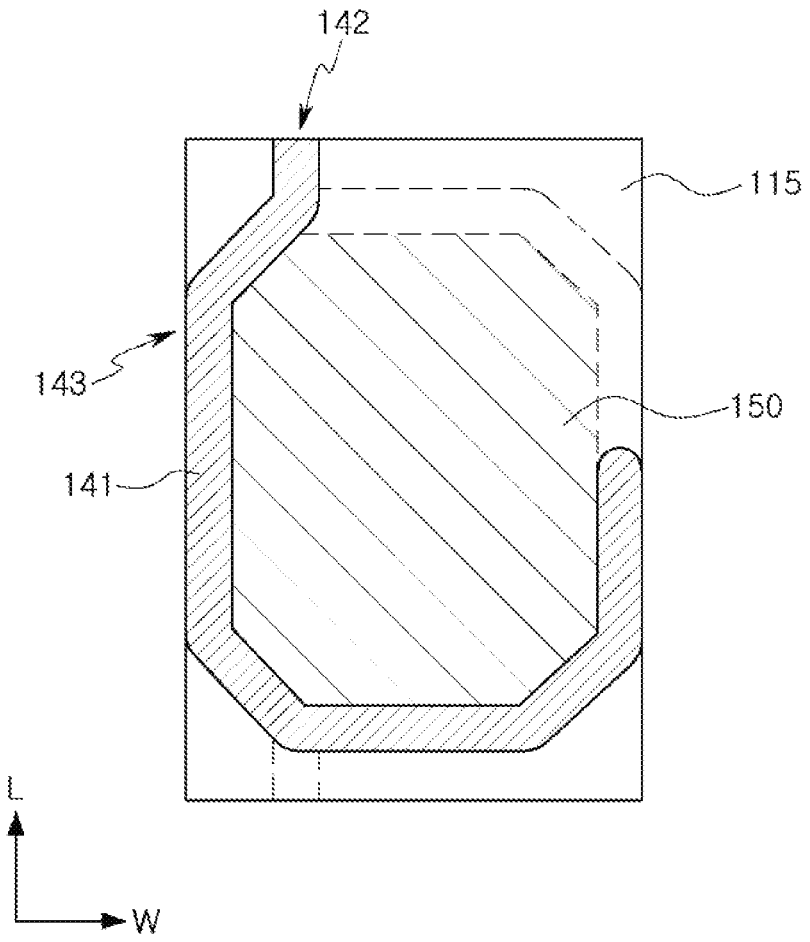
FIG. 5 is a schematic top view of a sheet on which a coil pattern is disposed, in a chip inductor, according to an exemplary embodiment.

FIG. 4 is a schematic perspective view of a laminate 110 of a chip inductor 100 according to an exemplary embodiment, while FIG. 5 is a schematic top view of a sheet 115 in which a coil pattern 141 is disposed, in a chip inductor 100, according to an exemplary embodiment.

With reference to FIG. 4, a coil 140 may be electrically connected to an external electrode 120 disposed on opposing surfaces of the laminate 110 in a length direction L, by a lead portion 142. In addition, the coil 140 may include an exposed portion 143, exposed outwardly of opposing surfaces of the laminate 110 in the length direction L.

In other words, as illustrated in FIG. 5, the coil pattern 141 may be disposed in such a manner that a portion of the coil pattern 141 is in contact with an edge of the sheet 115. Therefore, an area in an interior of the coil 140 formed in such a manner that the coil patterns 141 are connected may be increased, thus increasing inductance of the chip inductor 100.

A non-magnetic insulating layer 130 may be disposed on an external surface of the laminate 110 in order to cover the exposed portion 143, exposed outwardly of the laminate 110. The non-magnetic insulating layer 130 may be formed using a non-magnetic ferrite paste or an organic compound insulating film. In a case in which the non-magnetic insulating layer 130 is formed using the non-magnetic ferrite paste, a sintering process may be performed at about 900° C. in a manufacturing process. On the other hand, the non-magnetic insulating layer 130 may be improved in such a manner that the non-magnetic insulating layer 130 is formed using the organic compound insulating film which may be formed only using a curing process at about 200° C. In a case in which the non-magnetic insulating layer 130 is formed using the organic compound insulating film, the non-magnetic insulating layer 130 may be formed after an external electrode is formed.

Since the non-magnetic insulating layer 130 is formed of a non-magnetic material, magnetic flux may be blocked, rather than simply restricted, thus improving DC-bias characteristics of the chip inductor 100. In addition, the non-magnetic insulating layer 130 may prevent a conductive foreign substance from entering an exposed portion of the coil 140, thus improving reliability of the chip inductor 100.

In addition, in a loop-type pattern formed in such a manner that the coil patterns 141 are overlapped when the coil 140 is projected from a top surface in a vertical direction, a region disposed outside of the loop-type pattern may be formed to be a non-magnetic material, in the laminate 100. Therefore, a portion of magnetic flux may not be restricted, but magnetic flux may be blocked in an entirety of a region of the loop-type pattern, thus significantly improving DC-bias characteristics of the chip inductor 100.

Therefore, a capacity of the chip inductor 100, according to an exemplary embodiment, may be increased, and DC-bias characteristics of the chip inductor 100 may be improved, simultaneously.

In addition, the non-magnetic insulating layer 130 may be formed to be thinner than the external electrode 120, thus increasing the capacity of the chip inductor 100 while an area of a substrate is not increased, required in mounting the chip inductor 100, and improving DC-bias characteristics of the chip inductor 100, simultaneously.

Figure 6:
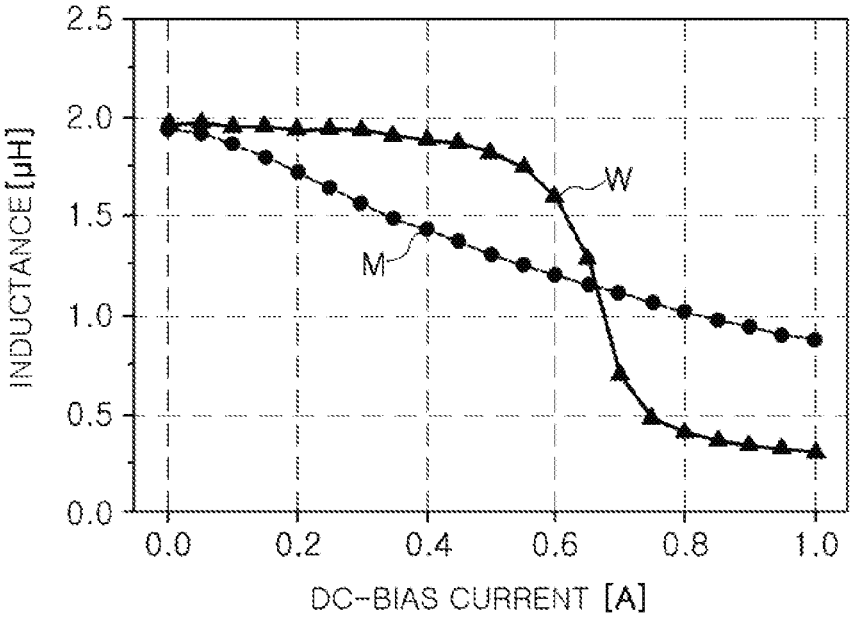
FIG. 6 is a graph comparing DC-bias characteristics of a wirewound inductor W and a multilayer chip inductor M.

FIG. 6 is a graph comparing DC-bias characteristics of a wirewound inductor W and a multilayer chip inductor M.

In terms of a DC bias of the multilayer chip inductor M of a prior art, a problem in which a constant level of inductance is not maintained at a specific level in an electric current, but continuously reduced may occur. On the other hand, inductance of the wirewound inductor W may be maintained at a specific level in an electric current. In other words, in general, as a level of an electric current flowing through a coil is increased, inductance of an inductor may be significantly reduced due to magnetic saturation of a magnetic material having high magnetic permeability. However, the wirewound inductor W may form an air gap in a predetermined space on an external surface of the coil and restrict magnetic saturation, thus preventing a reduction in inductance, caused by an increase in a level of an electric current.

In a manner the same as the wirewound inductor W, the chip inductor 100, according to an exemplary embodiment, may only include a non-magnetic material disposed on the edge of the loop-type pattern. Therefore, in a manner the same as the wirewound inductor W having the air gap, the chip inductor 100 may also restrict magnetic saturation, thus preventing a reduction in inductance, caused by an increase in a level of an electric current.

A Method of Manufacturing a Chip Inductor

FIGS. 7 to 13 illustrate a method of manufacturing a chip inductor in sequence, according to a different exemplary embodiment.

Figure 7:
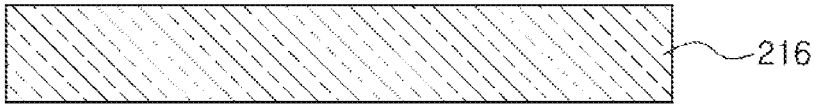
FIGS. 7 to 13 illustrate a method of manufacturing a chip inductor in sequence, according to a different exemplary embodiment.

As illustrated in FIG. 7, in a method of manufacturing a chip inductor, according to an exemplary embodiment, a first sheet 216 formed of a magnetic material may first be provided.

The first sheet 216 may be formed of a magnetic material having ferromagnetic properties, and in detail, may include NiO. In addition, the first sheet 216 may include a Ni—Cu—Zn-based ferrite material of which a mole ratio of Ni to Zn is about 1:1. Therefore, the first sheet 216 may have magnetic properties of high magnetic permeability and saturation magnetization.

The first sheet 216 may act as a cover layer in a laminate of a chip inductor, and may have magnetic properties of high magnetic permeability and saturation magnetization. Therefore, the first sheet 216 may protect a coil of the chip inductor, thus improving reliability and magnetic properties of the chip inductor.

Figure 8:
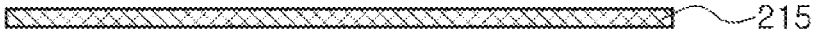

Subsequently, as illustrated in FIG. 8, a second sheet 215 formed of a non-magnetic material which does not have magnetic properties at room temperature may be provided. The second sheet 215 may be formed to be a plate-type portion having a flat central region. In addition, the second sheet 215 may include a Zn-based ferrite material or a Zn—Cu-based ferrite material, not containing NiO. The second sheet ZnO may include 10 mol % to 40 mol % of ZnO.

Figure 9:
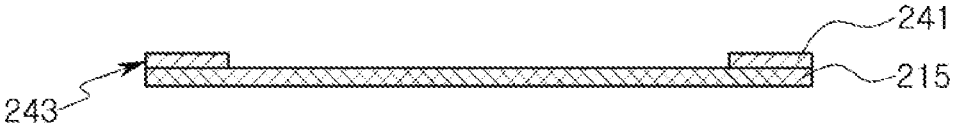

Subsequently, as illustrated in FIG. 9, a spiral coil pattern 241 may be formed on an edge of the second sheet 215. Alternatively, the spiral coil pattern 241 may be formed to be in contact with a cutting line in a case in which the second sheet 215 is subsequently cut and provided as an individual chip inductor.

The coil pattern 241 may be formed on the edge of the second sheet 215 or to be in contact with the cutting line, thus including an exposed portion, exposed outwardly of a surface of the laminate in a case in which the laminate to be subsequently described is formed.

In a case in which n sections of the coil pattern 241, divided based on a conductive via disposed along a loop-type pattern, are disposed when the loop-type pattern is formed by a coil formed in such a manner that the coil patterns 241 are connected to each other by the conductive via when viewed from above, a single coil pattern 241 may have n−1 sections.

The coil pattern 241 may be provided as a portion of the coil surrounding a core of the chip inductor, formed using a conductive material, and formed using Ag, Cu, or the like. The coil pattern 241 may be formed using a screen printing method, but the present disclosure is not limited thereto.

Figure 10:
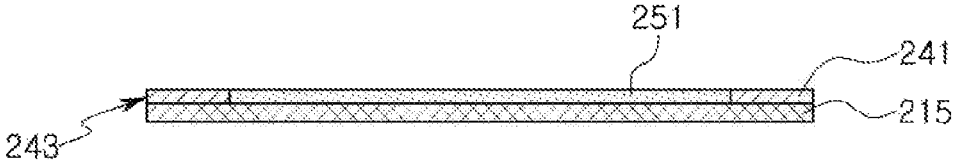

Subsequently, as illustrated in FIG. 10, a magnetic layer 251 including NiO may be formed in a central region on the second sheet 215, that is, in a central region of the coil pattern 241.

Figure 14:
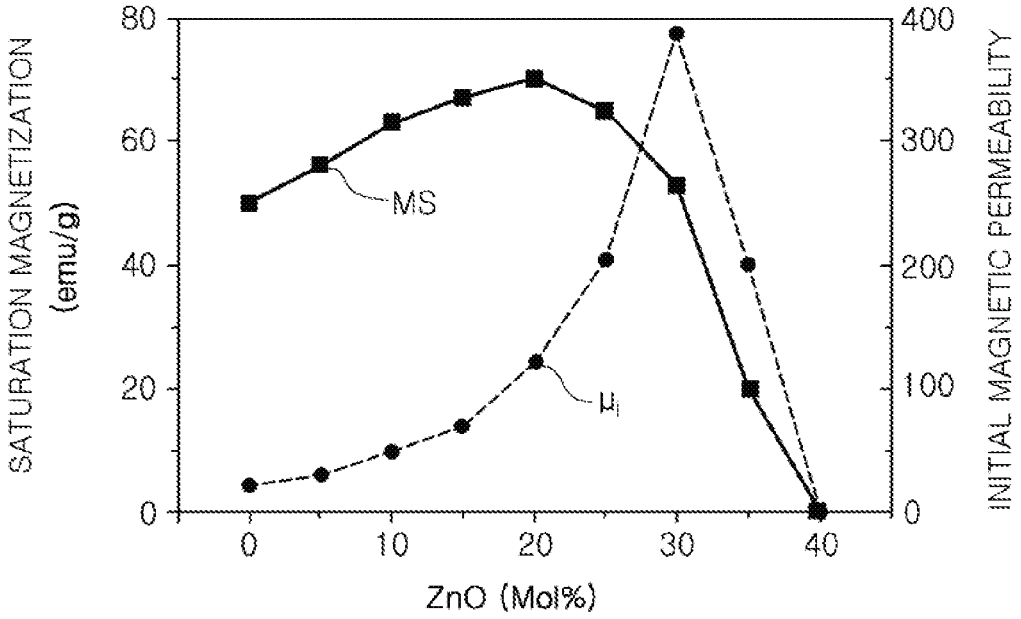
FIG. 14 is a graph illustrating characteristics based on a change in a composition by diffusion during a sintering process, in a method of manufacturing a chip inductor, according to a different exemplary embodiment.

The magnetic layer 251 may include 25 mol % to 40 mol % of NiO. Furthermore, the magnetic layer 251 may include 5 mol % to 35 mol % of ZnO. As illustrated in FIG. 14, a graph illustrating a change of physical properties of the magnetic layer 251, in a case in which the magnetic layer 251 includes 0 mol % of ZnO, an initial magnetic permeability ($\mu_i$) may be 20, and may be increased to 400 as a content of ZnO is increased. In this case, the content of ZnO, corresponding to 400 of the maximum initial magnetic permeability ($\mu_i$), may be about 30 mol %. In a case in which the content of ZnO is increased beyond 30 mol %, the initial magnetic permeability ($\mu_i$) may be continuously reduced, and at a point at which the content of ZnO is 40 mol %, the initial magnetic permeability ($\mu_i$) may not be changed, but may reach 0 although the content of ZnO is 40 mol % or more. Therefore, an entirety of magnetic properties of the magnetic layer 251 may disappear, and the magnetic layer 251 may be provided as a non-magnetic material. In addition, the second sheet 215 may have a composition in which a content of NiO is 0 mol %.

The composition of the magnetic layer 251 may be determined depending on a ratio of a thickness of the second sheet 215 to a thickness of the magnetic layer 251. In general, in order to secure excellent DC resistance (Rdc) characteristics, the second sheet 215 may be thinner than the coil pattern 241, while a thickness of the magnetic layer 251 may be similar to that of the coil pattern 241. Therefore, in a case in which the magnetic layer 251 is simply formed using a Ni—Cu-based ferrite, in the chip inductor provided as a final product, a content of Ni may be higher than that of Zn in a diffusion portion, that is, the Ni—Cu—Zn-based ferrite of the core, thus reducing magnetic permeability.

In detail, in a case in which the thickness of the magnetic layer 251 is twice than that of the second sheet 215, and the thickness of the magnetic layer 251 and the thickness of the second sheet 215 are reduced at the same rate after a sintering process, a composition ratio thereof may be as illustrated in FIG. 1.

TABLE 1

| | NiO [mol %] | ZnO [mol %] | CuO [mol %] | $Fe_2O_3$ [mol %] | Thickness [μm] |
|---|---|---|---|---|---|
| Composition of Second Sheet | 0 | 40 | 11 | 49 | 10 |
| Composition of Magnetic Layer | 30 | 10 | 11 | 49 | 20 |
| Composition of Diffusion Portion after Sintering Process | 20 | 20 | 11 | 49 | 30 |

In a case in which a sintering process among processes is performed at a high temperature, the content of ZnO in the second sheet 215 may be relatively high. Therefore, ZnO may diffuse into the magnetic layer 251. On the other hand, since the content of NiO in the magnetic layer 251 is relatively high, NiO may diffuse into the second sheet 215.

In a case in which the magnetic layer 251 includes 25 mol % to 40 mol % of NiO, magnetic permeability and magnetic saturation (Ms) of the magnetic layer 251 may increase by ZnO diffused from the second sheet 215, thus increasing magnetic properties of the magnetic layer 251, when the magnetic layer 251 is bonded to the second sheet 215. On the other hand, since NiO diffuses from the magnetic layer 251, and the content of NiO is increased, magnetic properties of the second sheet 215 may be gradually increased. Therefore, magnetic properties of the second sheet 215 and the magnetic layer 251 may be increased by diffusion of NiO. Compositions of the second sheet 215 and the magnetic layer 251 may be determined in advance so that a new magnetic material may have a composition similar to that of the first sheet 216.

In addition, a sintering accelerator may be added to the magnetic layer 251. In this case, the sintering accelerator may be added thereto, in order to accelerate diffusion of the magnetic layer 251 in a heating process to be subsequently described. A low melting-point oxide, such as bismuth oxide ($Bi_2O_3$) or the like, or glass, may be used as the sintering accelerator. In order to prevent excessive diffusion, a content of the sintering accelerator may be limited to less than 2% of $Bi_2O_3$ and less than 3% of glass.

Figure 11:
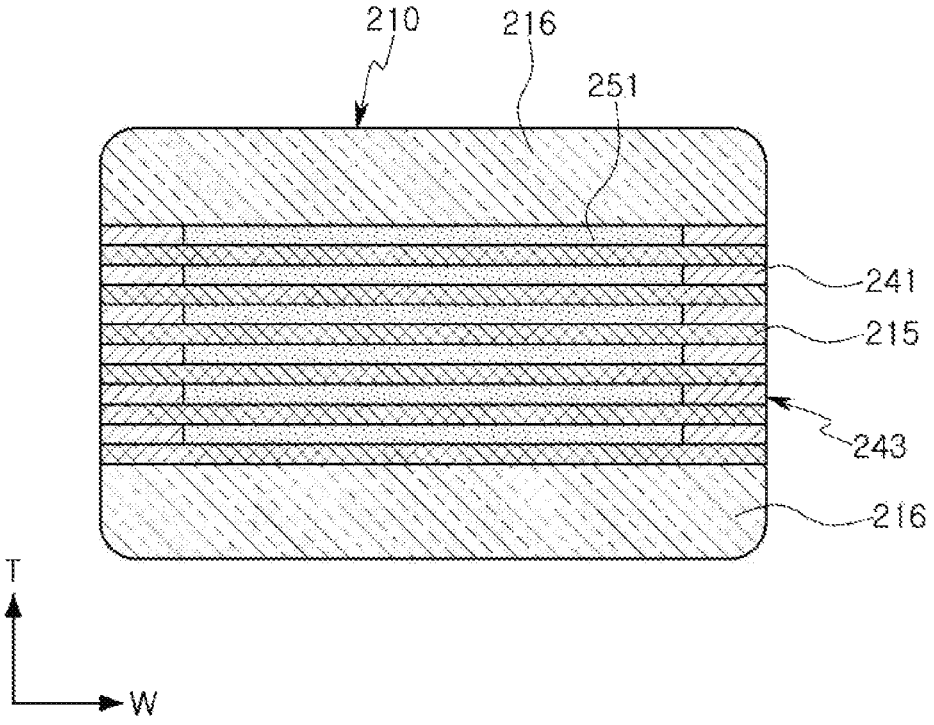

After the magnetic layer 251 is formed in the central region on the second sheet 215, the laminate 210 may be provided in such a manner that the first sheet 216, a plurality of second sheets 215 including the coil pattern 241 formed thereon, and the first sheet 216 are stacked in sequence, as illustrated in FIG. 11. The laminates 210 may be pressurized and adhered to each other.

Figure 12:
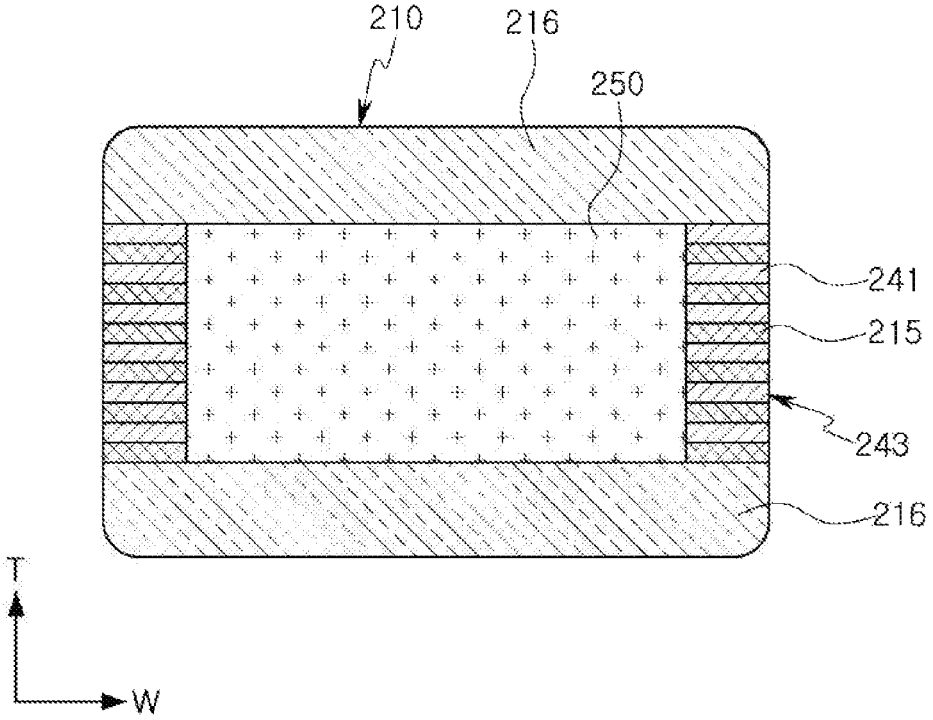

Subsequently, in a case in which the laminate 210 is heated to a predetermined temperature after being pressurized, as illustrated in FIG. 12, the magnetic layer 251 including ZnO and NiO may be diffused into peripheral regions. In this case, the magnetic layer 251 and a portion of the second sheet 215 which is in contact with the magnetic layer 251 may have physical properties similar to that of the first sheet 216 by mutual diffusion, thus forming a diffusion portion 250.

The second sheet 215 disposed on an edge of the loop-type pattern formed by the coil when viewed from above may still have non-magnetic characteristics, which is not illustrated in FIG. 12. Therefore, the second sheet 215 disposed on the edge of the loop-type pattern may act as a gap in the chip inductor. In other words, the diffusion portion 250 having uniform physical properties and the first sheet 216 disposed on and below the diffusion portion 250, may be integrated, and may act as a bobbin of a prior art wirewound inductor.

Figure 13:
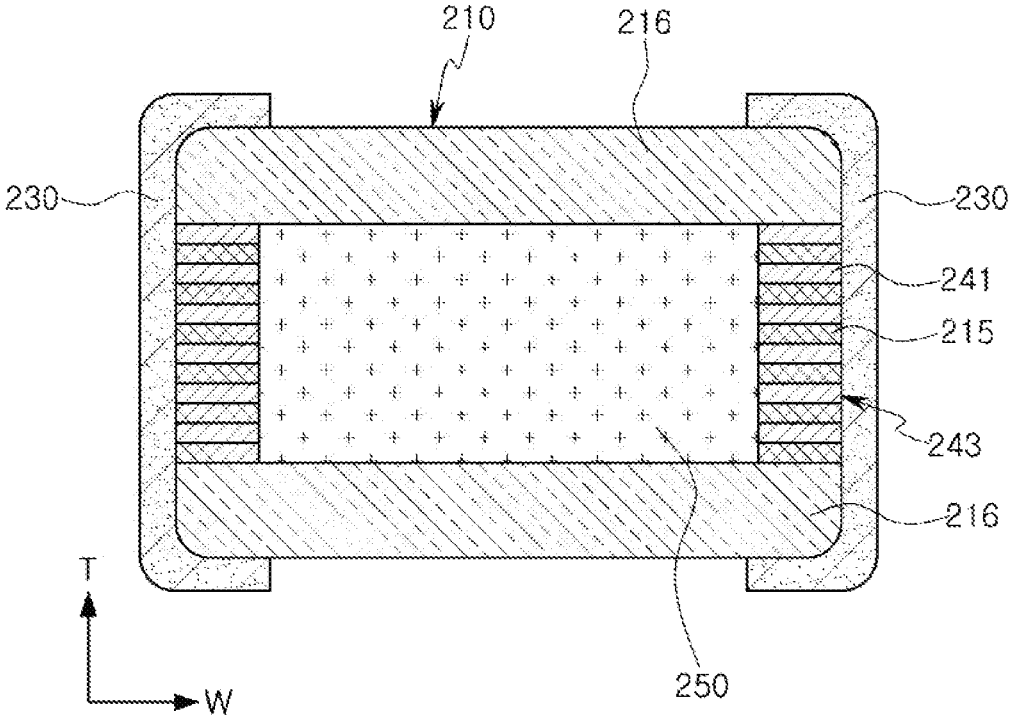

Furthermore, as illustrated in FIG. 13, a non-magnetic insulating layer 230 may be disposed on an external surface of the laminate 210 to cover an exposed portion 243.

In the chip inductor manufactured using the method of manufacturing a chip inductor, according to an exemplary embodiment, the second sheet 215 formed of a non-magnetic material may be disposed on the edge of the loop-type pattern formed by the coil when viewed from above, and the non-magnetic insulating layer 230 may be disposed on the external surface of an exposed portion 253. Therefore, a region in which the non-magnetic insulating layer 230 is disposed may perform a function the same as that of a prior art air gap, thus restricting magnetic flux. Consequently, since saturation magnetization of the chip inductor is restricted, a DC bias having a high level of an electric current may not have a relatively low level of inductance, but may maintain a specific level of inductance, in a manner the same as inductance of a prior art chip inductor.

As set forth above, according to an exemplary embodiment, a chip inductor may include a coil having an exposed portion, exposed outwardly of at least one surface of a laminate, thus increasing an area of the coil and inductance. In addition, since a non-magnetic insulating layer may be disposed on an external surface of the laminate to cover the exposed portion, magnetic flux may be blocked, thus improving DC-bias characteristics.

While exemplary embodiments have been shown and described above, it will be apparent to those skilled in the art that modifications and variations could be made without departing from the scope of the present invention as defined by the appended claims.

What is claimed is:

1. A chip inductor, comprising:

a laminate including a plurality of sheets stacked in the laminate;

a coil disposed in the laminate and including an exposed portion in which a portion of the coil is exposed outwardly of at least one surface of the laminate; and a non-magnetic insulating layer disposed on an external surface of the laminate to cover the exposed portion of the coil, wherein a substantial portion of an outermost region of the laminate is made of at least one non-magnetic material.

2. The chip inductor of claim 1, wherein the exposed portion of the coil is disposed on opposing surfaces of the laminate in a width direction.

3. The chip inductor of claim 1, further comprising a diffusion portion disposed in a central region of the coil.

4. The chip inductor of claim 3, wherein the diffusion portion is formed of a nickel (Ni)-copper (Cu)-zinc (Zn) ferrite.

5. The chip inductor of claim 3, wherein when viewed from above, the coil configures a loop-type pattern, and a region disposed outside of the loop-type pattern is formed of a non-magnetic material.

6. The chip inductor of claim 1, further comprising an external electrode disposed on the external surface of the laminate, wherein the non-magnetic insulating layer is thinner than the external electrode.

7. The chip inductor of claim 3, wherein the diffusion portion includes at least one magnetic material and at least one non-magnetic material.

* * * * *